US011160387B2

(12) United States Patent
Just

(10) Patent No.: US 11,160,387 B2
(45) Date of Patent: Nov. 2, 2021

(54) MATTRESS WITH OVERLAPPING EDGE SEGMENTS

(71) Applicant: MADAD PTY LTD, Queensland (AU)

(72) Inventor: Morrison John Just, Queensland (AU)

(73) Assignee: MADAD PTY. LTD., Wacol (AU)

( * ) Notice: Subject to any disclaimer, the term of this patent is extended or adjusted under 35 U.S.C. 154(b) by 88 days.

(21) Appl. No.: 16/328,868

(22) PCT Filed: Aug. 25, 2017

(86) PCT No.: PCT/AU2017/050910

§ 371 (c)(1),
(2) Date: Feb. 27, 2019

(87) PCT Pub. No.: WO2018/039708

PCT Pub. Date: Mar. 8, 2018

(65) Prior Publication Data

US 2019/0208919 A1 Jul. 11, 2019

(30) Foreign Application Priority Data

Aug. 29, 2016 (AU) ..... 2016903434

(51) Int. Cl.

| | |
|---|---|
| ***A47C 23/05*** | (2006.01) |
| ***A47C 27/00*** | (2006.01) |
| ***A47C 27/04*** | (2006.01) |
| ***A47C 27/05*** | (2006.01) |
| ***A47C 23/00*** | (2006.01) |

(52) U.S. Cl.

CPC ..... *A47C 23/05* (2013.01); *A47C 23/007* (2013.01); *A47C 27/001* (2013.01); *A47C 27/04* (2013.01); *A47C 27/05* (2013.01)

(58) Field of Classification Search

CPC ..... A47C 23/05; A47C 23/007; A47C 27/001; A47C 27/04; A47C 27/05; A47C 27/003; A47C 27/066

USPC ..... 5/701

See application file for complete search history.

(56) References Cited

U.S. PATENT DOCUMENTS

| | | | | |
|---|---|---|---|---|
| 4,998,310 A * | 3/1991 | Olson | ..... | A47C 19/005 5/201 |
| 5,787,532 A * | 8/1998 | Langer | ..... | A47C 27/066 5/717 |
| 6,263,533 B1 | 7/2001 | Dimitry et al. | | |

(Continued)

OTHER PUBLICATIONS

International Search Report for International Application No. PCT/AU2017/050910, dated Oct. 24, 2017, 4 pages.

*Primary Examiner* — Myles A Throop

(74) *Attorney, Agent, or Firm* — Edell, Shapiro & Finnan, LLC

(57) ABSTRACT

A mattress 10 that provides an edge support feature that remains firmly supportive throughout bending of the mattress on an adjustable foundation, while also providing a flat, tailored finish for the side of the mattress. The mattress has a base, an upper surface, and two side walls extending between two end walls such that the base, upper surface, side walls, and end walls define a cavity comprising a mattress support, such as a spring unit, that supports the upper surface above the base. The side walls and/or end walls comprise an edge support system having a plurality of overlapping edge segments.

24 Claims, 5 Drawing Sheets

(56) References Cited

U.S. PATENT DOCUMENTS

| | | | | |
|---|---|---|---|---|
| 6,832,397 | B2 * | 12/2004 | Gaboury | A47C 19/005 5/201 |
| 8,266,747 | B1 * | 9/2012 | Sobran | A47C 27/003 5/739 |
| D695,550 | S * | 12/2013 | Yiannaki | D6/606 |
| 2004/0188031 | A1 * | 9/2004 | Barman | B29C 66/727 156/515 |
| 2009/0013476 | A1 * | 1/2009 | Rinchetti | A47C 23/007 5/717 |
| 2010/0319137 | A1 | 12/2010 | Witherell et al. | |
| 2011/0049327 | A1 * | 3/2011 | Young | A47C 27/04 248/621 |
| 2011/0179579 | A1 * | 7/2011 | Henderson | A47C 27/066 5/717 |
| 2013/0263380 | A1 | 10/2013 | Young et al. | |
| 2013/0340177 | A1 | 12/2013 | Srour | |

* cited by examiner

MATTRESS WITH OVERLAPPING EDGE SEGMENTS

FIELD OF THE INVENTION

The invention relates to a mattress. In particular, the invention relates, but is not limited, to a flexible mattress which has articulating edge supported side walls for use on adjustable bed bases, or the like.

BACKGROUND TO THE INVENTION

Reference to background art herein is not to be construed as an admission that such art constitutes common general knowledge.

Mattresses are often used on bed bases, or the like, for resting and sleeping. There are various mattress constructions providing different characteristics. Innersprung mattresses, which are formed of a plurality of springs arranged between a mattress base and upper, have been found to be particularly popular.

Such mattresses may have an edge support that improves rigidity and durability of the mattress. The edge support can take many forms, from an edge wire of the springs, to a full perimeter border constructed from dense polyurethane foam. Such edge supports aim reduce 'roll-out' and provides a durable seating edge on the sides and/or ends of the mattress. One fairly unique way of providing edge support comprises thermally-welded polyethylene side walls to a polyethylene base to form a single integrated base and edge support system.

Adjustable bed bases where one or more portions of the bed base, typically one of the ends, can be raised and lowered, are increasing in popularity. Such adjustable bases have been known in the hospital industry for some time, but, they are now becoming available in the domestic bedding market.

As the adjustable bed base changes shape, the mattress is bent from a substantially flat planar shape towards one that generally matches the contours of the bed base. A problem of attempting to adjust a mattress with edge support is that the edge support is designed to be rigid and is not well suited to being bent. Although this issue applies to all edge support systems, it has been identified as being particularly problematic for the aforementioned polyethylene side walls edge support systems.

OBJECT OF THE INVENTION

It is an aim of this invention to provide a flexible mattress which overcomes or ameliorates one or more of the disadvantages or problems described above, or which at least provides a useful commercial alternative.

Other preferred objects of the present invention will become apparent from the following description.

SUMMARY OF INVENTION

In one form, although it need not be the only or indeed the broadest form, there is provided a mattress comprising:

a base and an upper surface; and two side walls extending between two end walls such that the base, upper surface, side walls, and end walls define a cavity comprising a mattress support that supports the upper surface above the base;

wherein one or more of the side walls and end walls comprises an edge support system having a plurality of overlapping edge segments.

Preferably end walls are affixed to the base. Preferably side walls are affixed to the base. Preferably the plurality of edge segments are affixed to the base. Preferably the base comprises a polyethylene plank. Preferably at least one of the end walls and side walls are made from polyethylene. Preferably the edges are made from a low density polyethylene foam. Preferably the edges are thermally welded to the base.

Preferably each of the edge segments comprise a side wall portion and a transverse portion. Preferably the transverse portion curves from the side wall portion. Preferably the transverse portion is substantially perpendicular to the side wall portion. Preferably the transverse portion extends into the cavity of the mattress. Preferably the transverse portion forms a trailing edge of the edge segment, and preferably a leading edge of the edge segment is tapered. Preferably the leading edge of the edge segment is resiliently flexible.

Preferably each of the edge segments comprise an anchor. Preferably the anchor is configured to anchor the edge segment to the mattress support. Preferably the anchor extends transverse to the side wall portion. Preferably the anchor extends substantially parallel to the transverse portion.

Preferably the anchor comprises a stem portion and a head portion. Preferably the stem portion is elongated. Preferably the head portion is enlarged relative to the stem portion. Preferably the head portion comprises at least one barb. Preferably the head portion comprises two barbs. Preferably the head portion comprises two opposed barbs. Preferably the anchor is substantially arrow shaped. Preferably the head portion of the anchor is resiliently flexible.

Preferably each of the edge segments is integral. Preferably each of the edge segments is formed from a low density polyethylene foam extrusion. Preferably the transverse portion is recessed from at least one of the top and bottom of the side wall. Preferably the anchor is recessed from at least one of the top and bottom of the side wall. Preferably the transverse portion and anchor are both recessed from both the top and bottom of the side wall.

Preferably the edge segments are affixed to the base such that the leading edge of an edge segment overlaps at least a portion of the transverse portion of an adjacent edge segment. Preferably the edge segments are fixed relative to each other adjacent the base and are movable relative to each other adjacent the upper surface. Preferably adjacent edge segments are movable relative to each other along substantially the entire length of their leading and trailing edges.

Preferably the edge segments are located between corner members. Preferably the corner members comprise anchors. Preferably the anchors are the same as, or at least substantially the same as, the anchors for the edge segments. Preferably the corner members extend along a portion of one end wall and one side wall.

Preferably the base and upper surface are substantially rectangular. Preferably the side walls are substantially parallel to each other. Preferably the end walls are substantially parallel to each other. Preferably the side walls are longer than the end walls. Preferably the side walls and end walls extend around a perimeter of the base and the upper surface. Preferably the mattress support comprises a spring unit. Preferably the spring unit comprises a plurality of springs. Preferably the springs comprise helical wires biased between the base and the upper surface. Preferably the base, side walls, and end walls form an integral casing that contains the spring unit. Preferably the spring unit is encased on five of its sides by the integral casing.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE DRAWINGS

Figure 1:
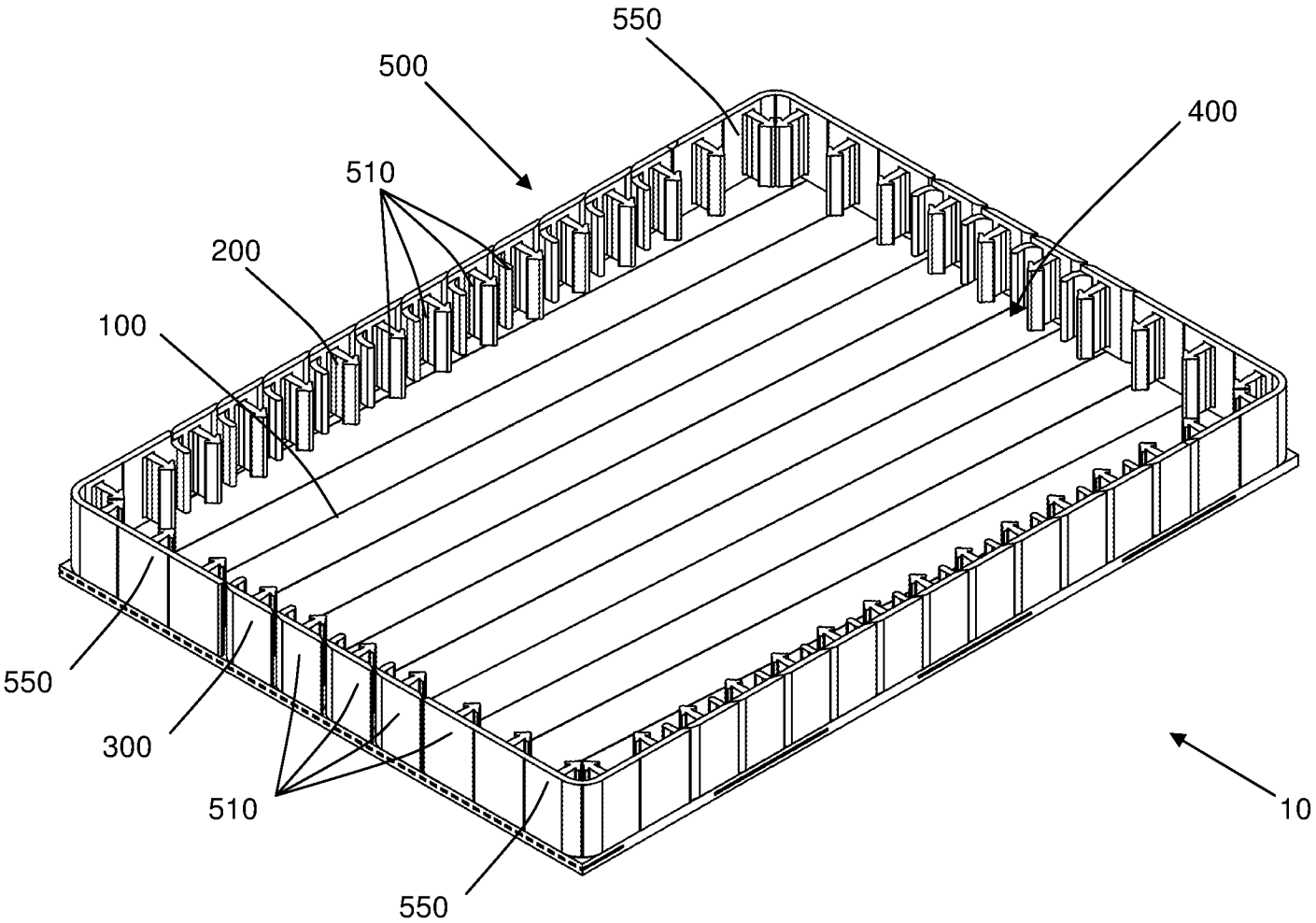
FIG. 1 illustrates a perspective view of a base, side walls, and end walls of a mattress including articulating edge segments along both the side walls and the end walls.
Figure 2:
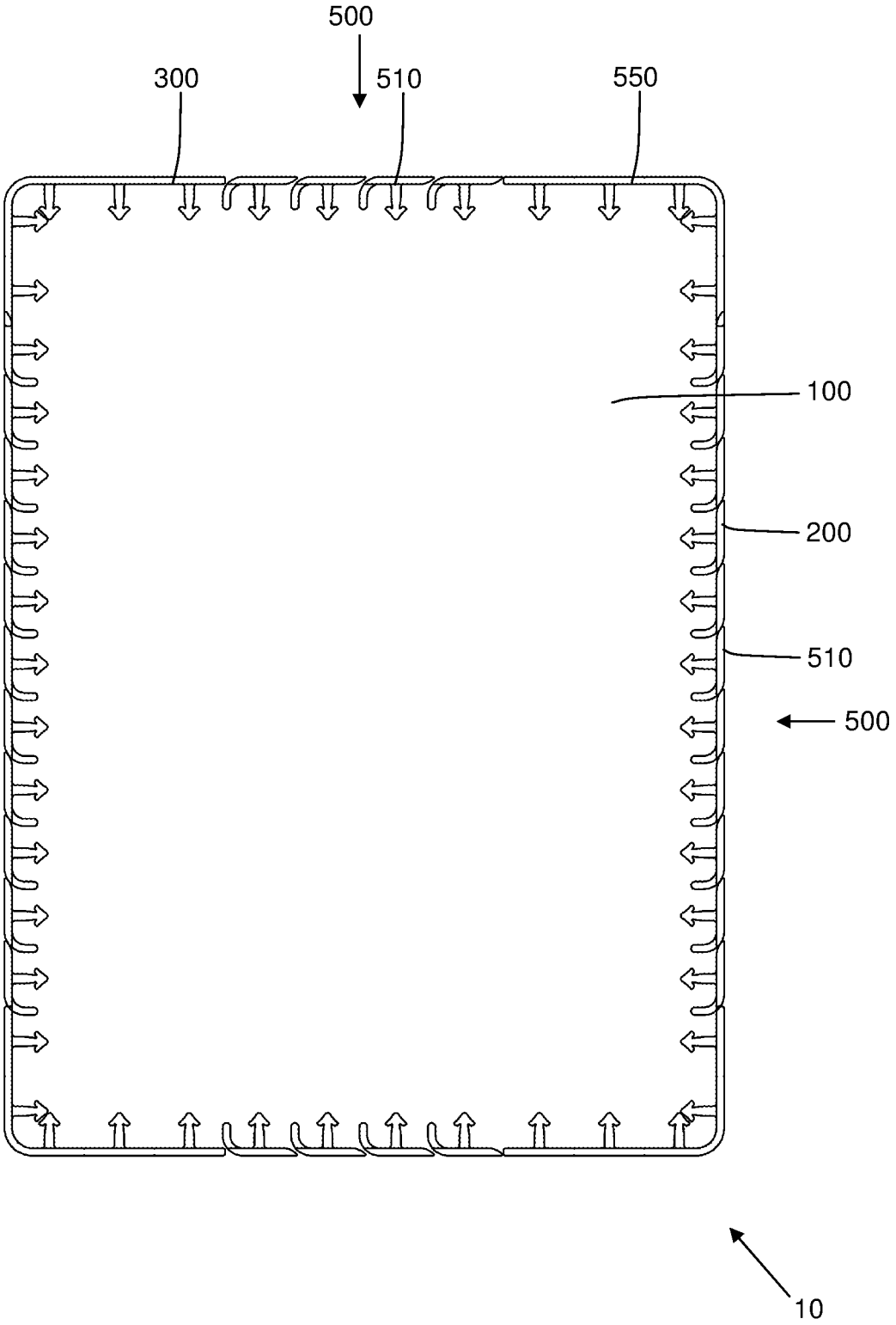
FIG. 2 illustrates a top plan view of the side walls and end walls of FIG. 1.

FIGS. 1 and 2 illustrates a portion of a mattress 10 having a base 100, two substantially parallel side walls 200, and two substantially parallel end walls 300 defining a cavity 400 therein. The side walls 200 and end walls 300 are affixed to the base 100, preferably thermally welded thereto, to form a substantially rectangular shaped integral casing for a suitably shaped mattress support (not shown) which is preferably in the form of a spring unit comprising a plurality of helical coil springs biased between the base the an upper surface (not shown for clarity).

In the illustrated embodiment both the side walls 200 and end walls 300 comprise edge support system 500 having a plurality of overlapping edge segments 510. The overlapping edge segments 510 are located between corner members 550 that each extend partially along one side wall 200 and one end wall 300.

It will be appreciated that the overlapping edge segments 510 may be provided in only one of the side walls 200 and end walls 300. Furthermore, it will be appreciated that the size and shape of the mattress 10 can be altered by adjusting the number of edge segments 510 in the side walls 200 and end walls 300. In this regard, for a single sized bed the edge segments 510 in the end walls 300 of the mattress 10 illustrated in FIGS. 1 and 2 are removed entirely such that adjacent the corner members 550 meet along, and define, the end walls 300.

Figure 3:
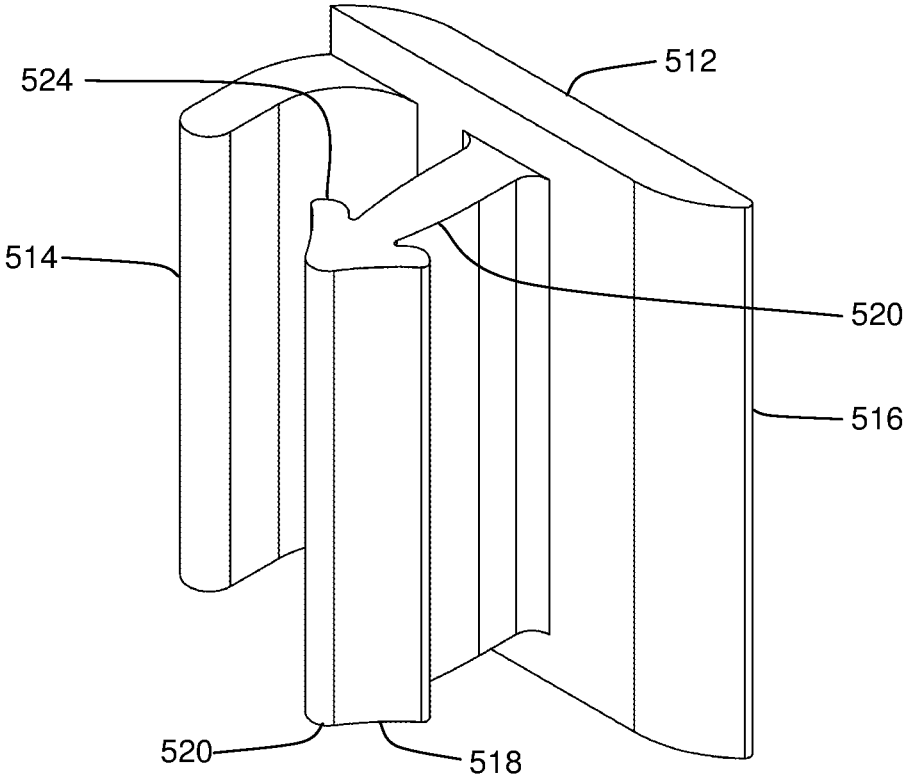
FIG. 3 illustrates a perspective view of a single edge segment of FIG. 1.
Figure 4:
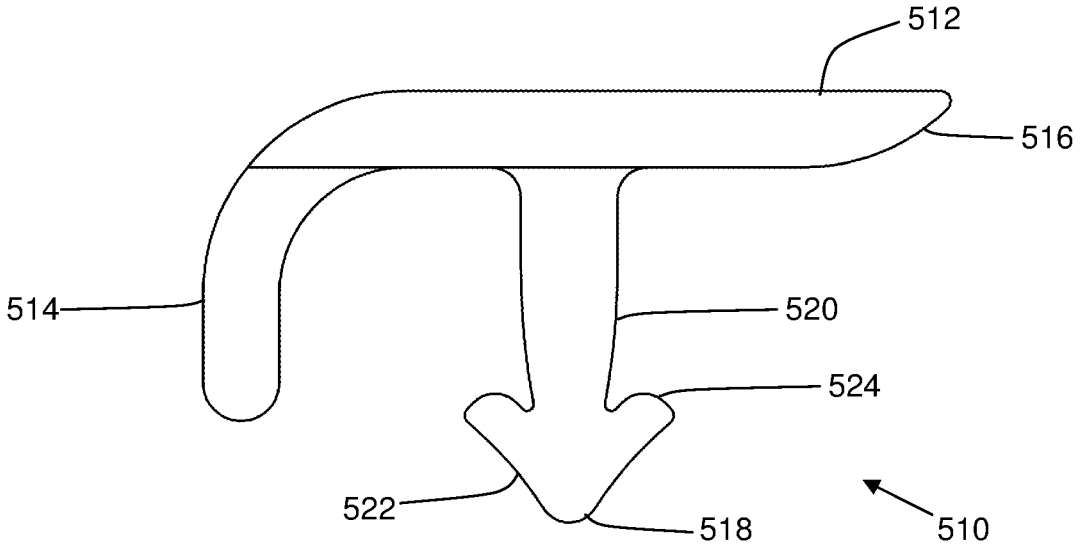
FIG. 4 illustrates a top plan view of the edge segment of FIG. 3.

FIGS. 3 and 4 show an edge segment 510 in greater detail. Each edge segment 510 comprises a side wall portion 512 and a transverse portion 514 that curves inward into the cavity 400 of the mattress 10, as seen in FIGS. 1 and 2, from the side wall portion 512. The transverse portion 514 is substantially perpendicular to the side wall portion 512 and forms a trailing edge of the edge segment 510. At an opposite side of the edge segment 510 to the transverse portion 514 is a leading edge 516 which is tapered.

The edge segment 510 also has an anchor 518 that extends substantially perpendicularly from an inner side of the side wall portion 512. The anchor 518 has an elongated stem portion 520 and a head portion 522 that is enlarged relative to the stem portion 520. The head portion has two opposed barbs 524 configured such that the anchor 518 is substantially arrow shaped.

The edge segment 510 is integral, preferably formed from a single piece of extruded low density polyethylene foam. Both the transverse portion 514 and anchor 518 are recessed from the top and bottom of the side wall portion 512. The edge segment 510 is resiliently flexible, with the thinner tapered portion of the leading edge 516 being a region of increased flexibility.

Figure 5:
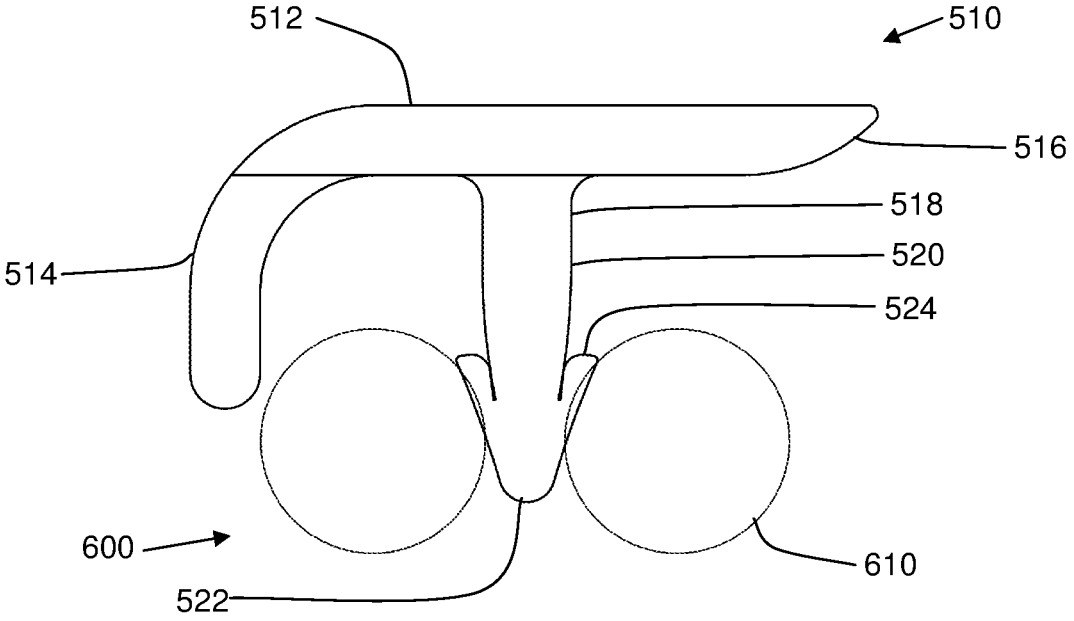
FIG. 5 illustrates a top plan view of an edge segment being inserted into a portion of a spring unit.
Figure 6:
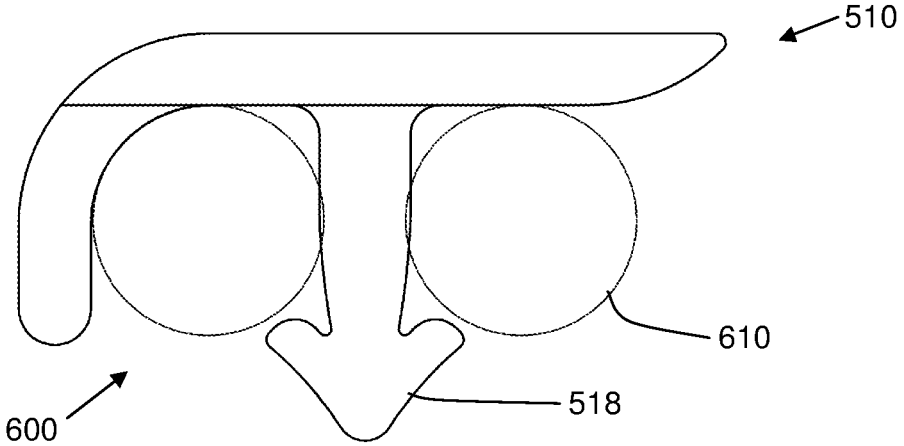
FIG. 6 illustrates the edge segment of FIG. 5 after insertion into the spring unit.
Figure 7:
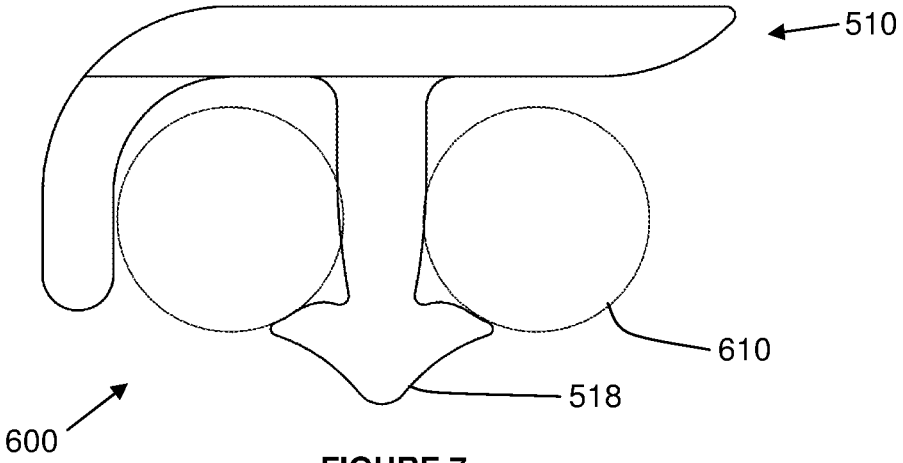
FIG. 7 illustrates the edge segment of FIG. 6 resisting withdrawal from the spring unit.

FIGS. 5 to 7 illustrate an edge segment 510 being inserted and withdrawn from a portion of a spring unit 600. Starting with FIG. 5, the anchor 518 of the edge segment 510 is inserted between two adjacent spring coils 610. The barbs 524 fold backwards and compress as they are forced between the spring coils 610 to enable the enlarged heard portion 522 to fit therebetween.

Once through, as illustrated in FIG. 6, the stem portion 520 is located between the spring coils 610, and the resiliently flexible head portion 522 returns to its original shape such that the barbs 524 extend beyond, and retain, the spring coils 610.

The anchor 518 prevents withdrawal and separation of the edge segment 510 from the spring unit 600 as illustrated in FIG. 7. The head portion 522 of the anchor 518, and in particular the barbs 524, engage with and catch on the spring coils 610 to prevent, or at least substantially inhibit, withdrawal of the anchor 518, and hence the edge segment 510, from the spring unit 600.

Figure 8:
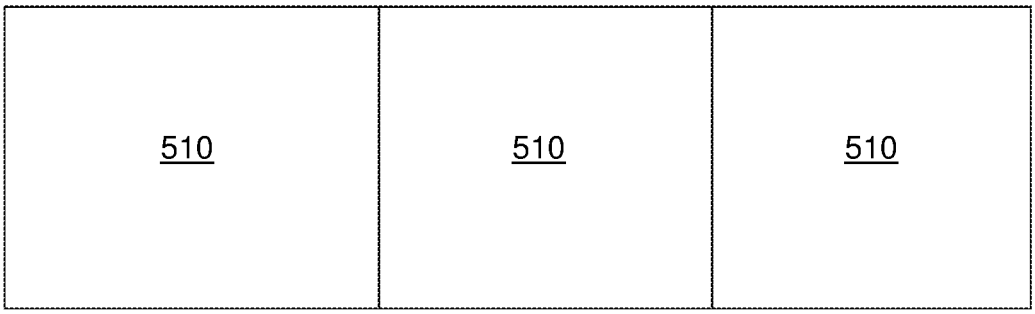
FIG. 8 illustrates a side elevation view of three overlapping edge segments in a flat configuration.
Figure 9:
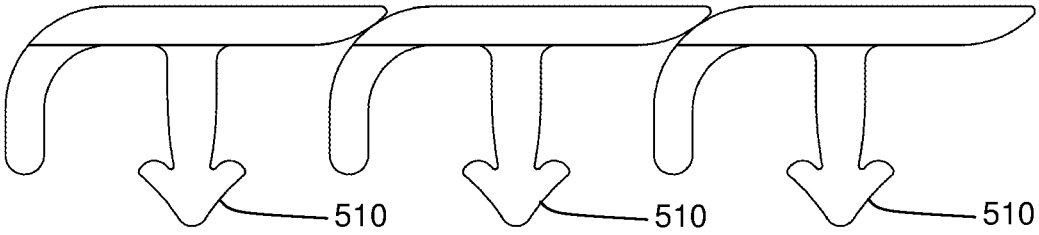
FIG. 9 illustrates a top plan view of the three edge segments of FIG. 8.

FIGS. 8 and 9 illustrate three edge segments 510 when the mattress 10 is in a flat, substantially planar, configuration. The edge segments are aligned linearly (as seen in FIG. 8) with the leading edge 516 of one segment overlapping the transverse portion 514 of an adjacent segment (as seen in FIG. 9).

Figure 10:
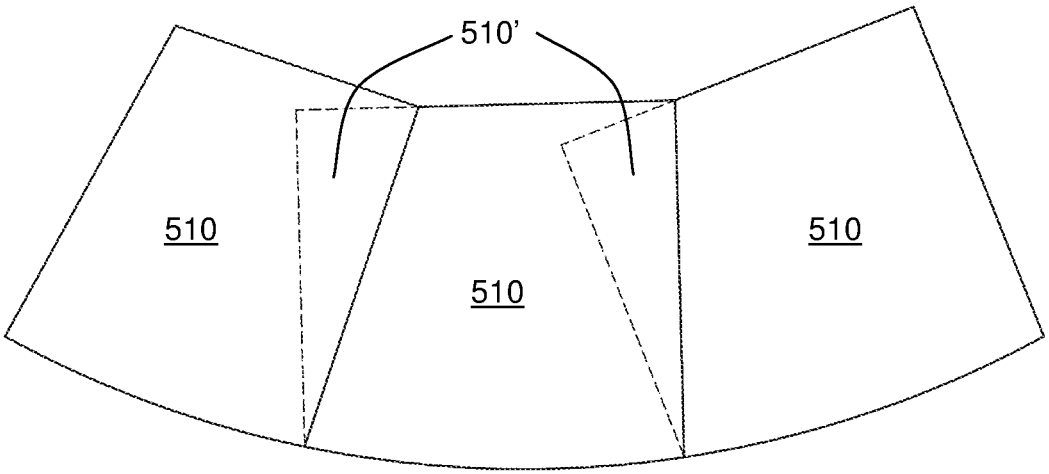
FIG. 10 illustrates a side elevation view of three overlapping edge segments in a curved configuration.
Figure 11:
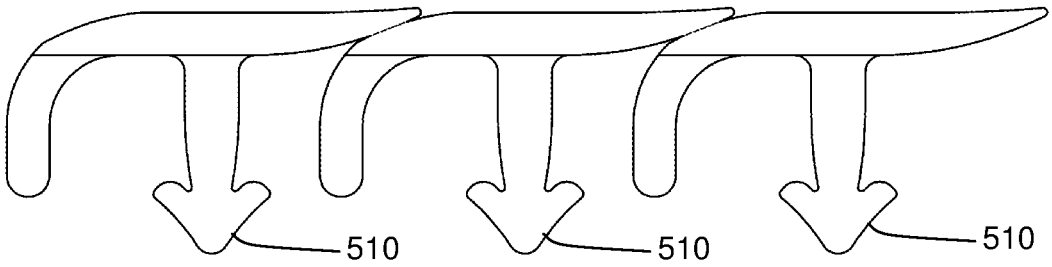
FIG. 11 illustrates a top plan view of the three edge segments of FIG. 10.

FIGS. 10 and 11 illustrate what happens when the mattress 10 is bent, such as due to an adjustable bed base being inclined, the edge segments 510 articulate to follow the bend. The edge segments 510 are affixed to the base 100 and, accordingly, the edge segments 510 are fixed relative to each other adjacent the base. However, the edge segments 510 are not affixed along their leading edges 516 or transverse portions 514 and, accordingly, the edge segments 510 are movable relative to each other along substantially the entire length of their leading and trailing edges. This enables the amount of overlap 510' between adjacent edge segments 510 to be increased as illustrated in FIG. 10. FIG. 11 illustrates how the edge segments 510 deform and overlap during such a bend while retaining a relative flat side wall.

In use, the edge support system 500 provides the mattress 10 with a well supported flat side wall 300 in both a flat configuration (e.g. as shown in FIGS. 8 and 9) and a bent configuration (e.g. as shown in FIGS. 10 and 11). This is achieved by having overlapping edge segments 510 that can vary the amount of overlap 510' as the mattress 10 is bent (e.g. compare FIGS. 8 and 10). The base 100 can bend as desired, typically by responding to movement of an adjustable bed base, and the edge segments 510 can vary the overlap 510' to accommodate the bend without bulging or rolling out.

Advantageously, the mattress 10 of the present invention provides an edge support feature that remains firmly supportive throughout bending of the mattress on an adjustable foundation, while also providing a flat, tailored finish for the side of the mattress. The anchors 518 also enable the side walls 200 and end walls 300 to be held securely to the spring unit 600, at all times, even during bending, or the like.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The invention claimed is:

1. A mattress comprising:

a base and an upper surface; and two side walls extending between two end walls such that the base, upper surface, side walls, and end walls define a cavity comprising a mattress support that supports the upper surface above the base;

wherein one or more of the side walls and end walls comprises an edge support system having a plurality of overlapping edge segments, and wherein each of the edge segments comprise a side wall portion and a transverse portion that curves from the side wall portion.

2. The mattress of claim 1, wherein the end walls and side walls are affixed to the base.

3. The mattress of claim 1, wherein the plurality of edge segments are affixed to the base.

4. The mattress of claim 1, wherein the base comprises a polyethylene plank.

5. The mattress of claim 1, wherein the edge segments are made from a polyethylene foam thermally welded to the base.

6. The mattress of claim 1, wherein the transverse portion is substantially perpendicular to the side wall portion.

7. The mattress of claim 1, wherein the transverse portion extends into the cavity of the mattress.

8. The mattress of claim 1, wherein the transverse portion forms a trailing edge of the edge segment and a resiliently flexible leading edge of the edge segment is tapered.

9. The mattress of claim 1, wherein each of the edge segments comprise an anchor configured to anchor the edge segment to the mattress support.

10. The mattress of claim 9, wherein the anchor extends transverse to the side wall portion.

11. The mattress of claim 9, wherein the anchor comprises a stem portion and a head portion.

12. The mattress of claim 11, wherein the stem portion is elongated and the head portion is enlarged relative to the stem portion.

13. The mattress of claim 12, wherein the head portion comprises at least one barb.

14. The mattress of claim 13, wherein the head portion comprises two opposed barbs.

15. The mattress of claim 11, wherein the head portion of the anchor is resiliently flexible.

16. The mattress of claim 1, wherein each of the edge segments is integral.

17. The mattress of claim 16, wherein each of the edge segments is formed from a polyethylene foam extrusion.

18. The mattress of claim 1, wherein the edge segments are affixed to the base such that a leading edge of an edge segment overlaps at least a portion of a transverse portion of an adjacent edge segment.

19. The mattress of claim 1, wherein the edge segments are fixed relative to each other adjacent the base and are movable relative to each other adjacent the upper surface.

20. The mattress of claim 1, wherein adjacent edge segments are movable relative to each other along substantially the entire length of their leading and trailing edges.

21. The mattress of claim 1, wherein the edge segments are located between corner members, wherein the corner members comprise anchors and extend along a portion of one end wall and one side wall.

22. The mattress of claim 1, wherein the base and upper surface are substantially rectangular, the side walls are substantially parallel to each other, the end walls are substantially parallel to each other, the side walls are longer than the end walls, and the side walls and end walls extend around a perimeter of the base and the upper surface.

23. The mattress of claim 1, wherein the mattress support comprises a spring unit comprising a plurality of springs.

24. The mattress of claim 23, wherein the springs comprise helical wires biased between the base and the upper surface.

* * * * *